US009079205B2

(12) United States Patent
Hoskins

(10) Patent No.: US 9,079,205 B2
(45) Date of Patent: Jul. 14, 2015

(54) DRINK BOTTLE AND CAP ASSEMBLY

(71) Applicant: Matt Hoskins, Bend, OR (US)

(72) Inventor: Matt Hoskins, Bend, OR (US)

( * ) Notice: Subject to any disclaimer, the term of this patent is extended or adjusted under 35 U.S.C. 154(b) by 84 days.

(21) Appl. No.: 14/020,680

(22) Filed: Sep. 6, 2013

(65) Prior Publication Data

US 2014/0061248 A1 Mar. 6, 2014

Related U.S. Application Data

(60) Provisional application No. 61/743,505, filed on Sep. 6, 2012.

(51) Int. Cl.

| | |
|---|---|
| ***B05B 11/04*** | (2006.01) |
| ***B65B 3/00*** | (2006.01) |
| ***B65D 23/10*** | (2006.01) |
| ***B65D 47/20*** | (2006.01) |
| ***B65D 51/16*** | (2006.01) |
| ***A47G 19/22*** | (2006.01) |

(52) U.S. Cl.

CPC ..... *B05B 11/047* (2013.01); *A47G 19/2266* (2013.01); *B65B 3/00* (2013.01); *B65D 23/106* (2013.01); *B65D 47/2037* (2013.01); *B65D 51/1644* (2013.01); *B65D 2547/066* (2013.01)

(58) Field of Classification Search

CPC .. A47G 21/185; A47G 21/186; B05B 11/047; B65B 3/00; B65D 1/326; B65D 23/106; B65D 2547/066; B65D 47/066; B65D 47/2018; B65D 47/2031; B65D 47/2037; B65D 51/1644

USPC ..... 222/212; 215/387–389; 220/703–719; 251/7

See application file for complete search history.

(56) References Cited

U.S. PATENT DOCUMENTS

| | | | | | |
|---|---|---|---|---|---|
| 2,755,974 | A | * | 7/1956 | Godfrey | 222/494 |
| 2,797,837 | A | * | 7/1957 | Roberts | 215/311 |
| 3,128,000 | A | * | 4/1964 | Haberle | 215/270 |
| 4,531,655 | A | * | 7/1985 | Putnam | 222/105 |
| 4,775,081 | A | * | 10/1988 | Morane | 222/402.13 |
| 4,830,227 | A | * | 5/1989 | Ball et al. | 222/207 |
| 5,297,686 | A | * | 3/1994 | Takeuchi | 215/396 |
| 5,505,345 | A | * | 4/1996 | Zeid | 222/402.1 |
| 6,039,305 | A | * | 3/2000 | Hoskins et al. | 251/342 |

(Continued)

FOREIGN PATENT DOCUMENTS

| | | | | | |
|---|---|---|---|---|---|
| CH | 276994 | A | * | 8/1951 | B65D 47/2037 |
| DE | 1141555 | B | * | 12/1962 | B65D 47/2037 |

(Continued)

*Primary Examiner* — Daniel R Shearer
*Assistant Examiner* — Nicholas J Weiss
(74) *Attorney, Agent, or Firm* — Klarquist Sparkman, LLP

(57) ABSTRACT

Disclosed are embodiments of a squeezable drink bottle and a cap assembly therefor. The cap assembly can comprise a rigid cap body configured to be secured to a liquid container, a spout comprising a resiliently flexible tube extending through a passageway in the cap body, and a shut-off trigger slidably mounted in the cap body and adjustable between an open position and a closed position relative to the cap body, wherein when the trigger is in the open position, the tube is open to allow liquid to flow through the spout, and when the trigger is in the closed position, the tube is closed to block liquid flow through the spout. The cap assembly can also include a mouthpiece valve that remains sealed until the bottle is squeezed to pressurize a lumen within the mouthpiece and squirt fluid out of the spout or the mouthpiece is pinched to open the seal.

18 Claims, 8 Drawing Sheets

(56) References Cited

U.S. PATENT DOCUMENTS

| | | | | |
|---|---|---|---|---|
| 6,276,560 | B1 * | 8/2001 | Belcastro | 220/709 |
| 7,097,078 | B2 * | 8/2006 | Sanchez | 222/402.21 |
| 7,533,783 | B2 * | 5/2009 | Choi et al. | 220/714 |
| 7,648,038 | B2 * | 1/2010 | Brozell | 215/396 |
| 7,931,175 | B2 * | 4/2011 | Hjort | 222/567 |
| 8,336,724 | B2 * | 12/2012 | Yamashita et al. | 220/254.1 |
| 8,376,173 | B2 * | 2/2013 | Britto et al. | 220/254.3 |
| 8,602,238 | B2 * | 12/2013 | El-Saden et al. | 215/389 |
| 8,646,658 | B2 * | 2/2014 | Bae | 222/182 |
| 2013/0175302 | A1 * | 7/2013 | Sariu | 222/212 |

FOREIGN PATENT DOCUMENTS

| | | | | |
|---|---|---|---|---|
| GB | 387446 | A * | 2/1933 | B65D 47/2037 |
| JP | 3524649 | B2 * | 5/2004 | B65D 47/2037 |

* cited by examiner

DRINK BOTTLE AND CAP ASSEMBLY

CROSS REFERENCE TO RELATED APPLICATION

This application claims the benefit of U.S. Provisional Application No. 61/743,505, filed on Sep. 6, 2012, which is hereby incorporated by reference in its entirety.

FIELD

This application relates to drink bottles, such as used for everyday and sports hydration.

BACKGROUND

Drink bottles are used in all sorts of situations as a convenient means of hydration. For certain activities, such as running or cycling, it is advantageous at times for the user to be able to employ the drink bottle to direct a squirt of fluid into their mouth. The most common design for achieving this consists of a squeezable bottle equipped with a screw-on cap featuring a pull-to-open, push-to-close spout. When in the open position, the spout's fluid channel is sized so that under pressure the fluid emerges from the bottle in a stream that is manageable for drinking. After squeezing the bottle to get a mouthful of fluid, the user relaxes their hand and air flows back into the bottle through the spout's channel. The push-pull spout may be opened and closed by the user with their hands or mouth.

A second type of commercially-available squirt mouthpiece consists of a diaphragm valve coupled with a spout that is constructed into a screw-top cap. The diaphragm valve works like a check valve and opens in response to pressure-generated in the bottle via the user's squeezing action. The diaphragm valve has a cracking pressure that is low enough to allow fluid to begin flowing under moderate bottle hand pressure, yet high enough so that fluid does not leak through the valve inadvertently. The diaphragm valve is designed such that it also works as a one-way valve, allowing air to re-enter the bottle after each squeeze. A spout is typically used in conjunction with the diaphragm valve to help direct flow from the valve and to provide a mouthpiece for the user. Certain diaphragm-valve equipped bottles include a manual shut-off valve to further protect against inadvertent leakage.

The mouthpieces and caps described above are typically sold with squeezable bottles that are sized for the hand and are generally cylindrical and are made of flexible plastic. If intended for bicycling, for example, the bottle may feature grooves or ribbing that allow the bottle to be retained in a bike-mounted bottle cage. For running, squeeze bottles may have a cross-sectional shape that is more oval to create a better fit against the runner's body.

Current squeeze bottles suffer a number of limitations. For example, bottle shapes often preclude efficient pressure generation. Push-pull spouts leak unless they are closed after each use. Diaphragm valve equipped bottles are difficult to manufacture and are relatively expensive. Further, for bottle manufacturers to meet the specific needs of each market niche may require the production of several different models.

Accordingly, there exists a need for an improved drink bottle that offers efficient stream generation, leak protection, and portability while providing manufacturing economy.

SUMMARY

Described herein are embodiments of squeezable drink bottles and cap assemblies therefor that provide efficient stream generation, leak protection, and portability while also providing manufacturing economy.

In some embodiments, a cap assembly comprises a rigid cap body configured to be secured to a liquid container, a spout comprising a resiliently flexible tube extending through a passageway in the cap body for conducting liquid, and a shut-off trigger slidably mounted in the cap body and adjustable between an open position and a closed position relative to the cap body. When the trigger is in the open position, a lumen within the tube is open to allow liquid to flow through the spout, and when the trigger is in the closed position, the lumen within the tube is closed to block liquid flow through the spout. The trigger can have a sealing edge that presses against a side of the tube and collapses the tube against a sealing surface of the cap body when the trigger is in the closed position, and the sealing edge moves away from the sealing surface of the cap body when the trigger moves toward the open position to allow the lumen with the tube to open. The trigger can further include a catch that engages with the cap body when the trigger is in the closed position to lock the trigger in the closed position, and the catch can be released from the cap body by a user to allow the trigger to move to the open position.

The tube can extends in a generally axial direction through the passageway in the cap body and the trigger can be slidable in directions generally perpendicular to the axial direction. The trigger can include a passageway through which the tube extends, and the sealing edge can be at one side of the passageway adjacent the tube. The cap body can comprise a slot that receives the trigger, and the slot can intersect the passageway through the cap through which the tube extends, such that the slot and the passageway in the cap body are generally transverse to each other.

In some embodiments, the trigger has a spring-like configuration. The trigger can comprise a first arm and a second arm that are coupled at an inner end portion of the trigger, such that the first and second arms are biased apart from each other by the inner end portion while being retained in proximity to each other by contact with the cap body. The first and second arms can be elastically bent toward each other when the trigger moves toward the closed position, and the first and second arms can resiliently separate apart from each other when the trigger moves toward the open position. The first arm can include the catch facing away from the second arm such that the catch is biased against the cap body. In such embodiments, when the trigger is in the closed position, the first arm must be bent toward the second arm to release the catch from the cap body and allow the trigger to move toward the open position.

In some embodiments, the sealing surface of the cap body is offset axially from the sealing edge of the trigger, such that when the trigger is in the closed position, the tube is kinked out of axial alignment.

In some embodiments, the spout includes a mouthpiece positioned on an upper side of the cap body and comprising a flexible outer sheath coupled to an upper end of the tube such that the inner lumen extends through the tube and the outer sheath, and a rigid stem positioned within the outer sheath such that the outer sheath and the stem form a valve that allows liquid flow from the tube, between the outer sheath and the stem, and out of the spout when the bottle is squeezed or when the outer sheath is pinched.

In some embodiments, the mouthpiece is rotatable relative to the cap body, such that rotating the mouthpiece relative to the cap body changes an angle at which the mouthpiece extends from the cap body. At one rotational position, the mouthpiece can extend upwardly from the cap body in a direction generally aligned with a longitudinal axis of the tube, and at other rotational positions, the mouthpiece can extend from the cap body at various angles from the longitudinal axis of the tube.

In some embodiments, a drink bottle comprises an elastically squeezable fluid container comprising an upper portion having a generally circular cross-sectional shape and a lower portion having a generally D-shaped or kidney-shaped cross-sectional shape.

The foregoing and other objects, features, and advantages of the disclosed technology will become more apparent from the following detailed description, which proceeds with reference to the accompanying figures.

DETAILED DESCRIPTION

Exemplary embodiments of a squeezable drink bottle and a cap assembly therefor are disclosed that provide efficient stream generation, leak protection, and portability while providing manufacturing economy. As shown in FIGS. 1-4, an exemplary drink bottle 10 includes a liquid container, or bottle, 12 and a removable cap assembly 14. The bottle 12 can be shaped for grasping and maximizing squeeze-induced pressurization and can be contoured so that it can be worn snugly against the body, such as for running or hiking, or easily holstered. The cap assembly 14 can include a spout 18 having a mouthpiece valve, a spout shut-off for quick and easy leak protection, and an air inlet for allowing air back into the bottle. In some embodiments, the mouthpiece can be adjusted by a user to various angles or directed straight up from the cap. The mouthpiece can be utilized as a squirt valve and/or a bite valve. The drink bottle 10 can also include a modular handle system that allows for the attachment of various types of handles and/or attachment mechanisms.

Figure 1:
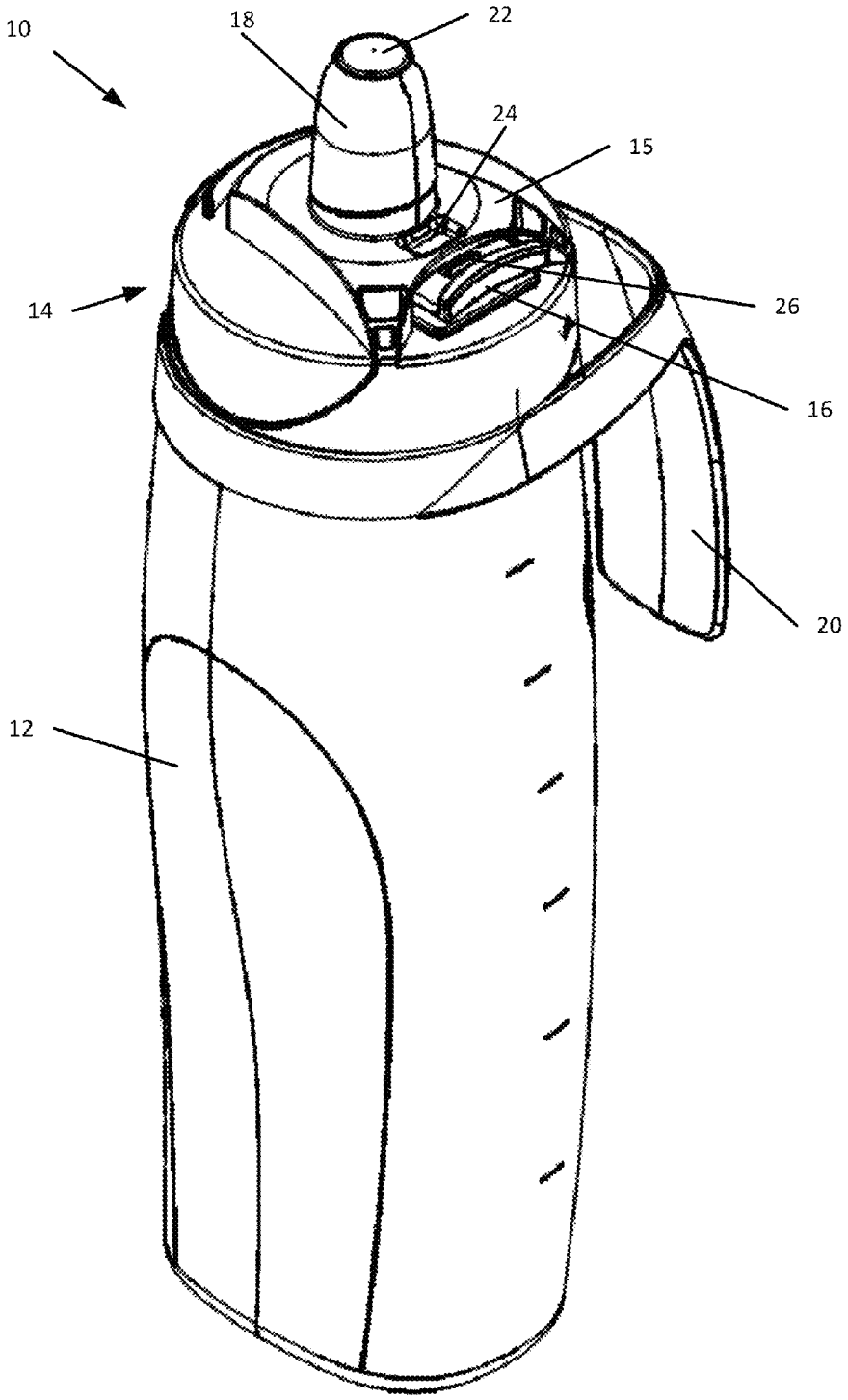
FIG. 1 is a perspective view of an exemplary drink bottle.
Figures 2, 3:
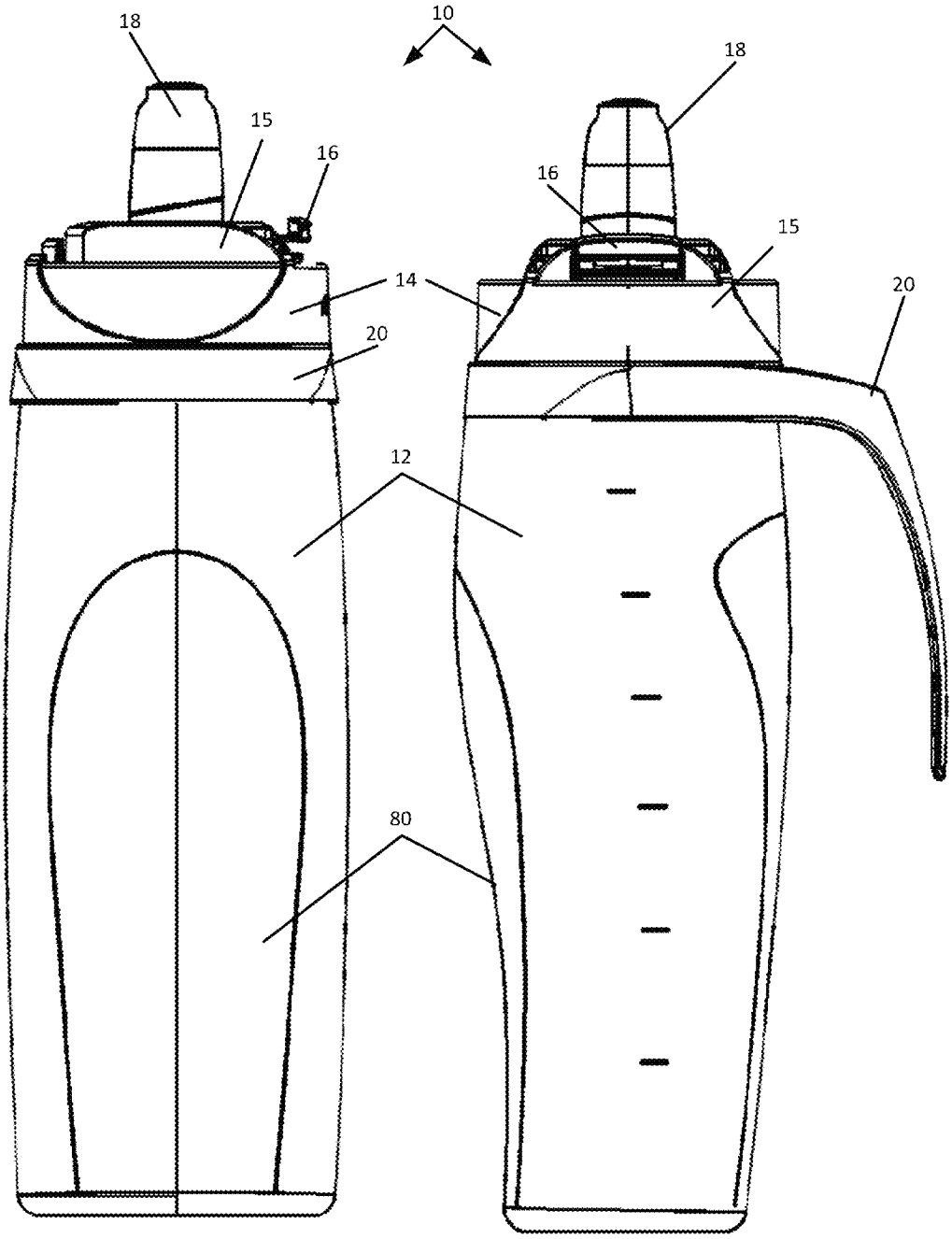
FIGS. 2 and 3 are side views of the drink bottle of FIG. 1.
Figure 4:
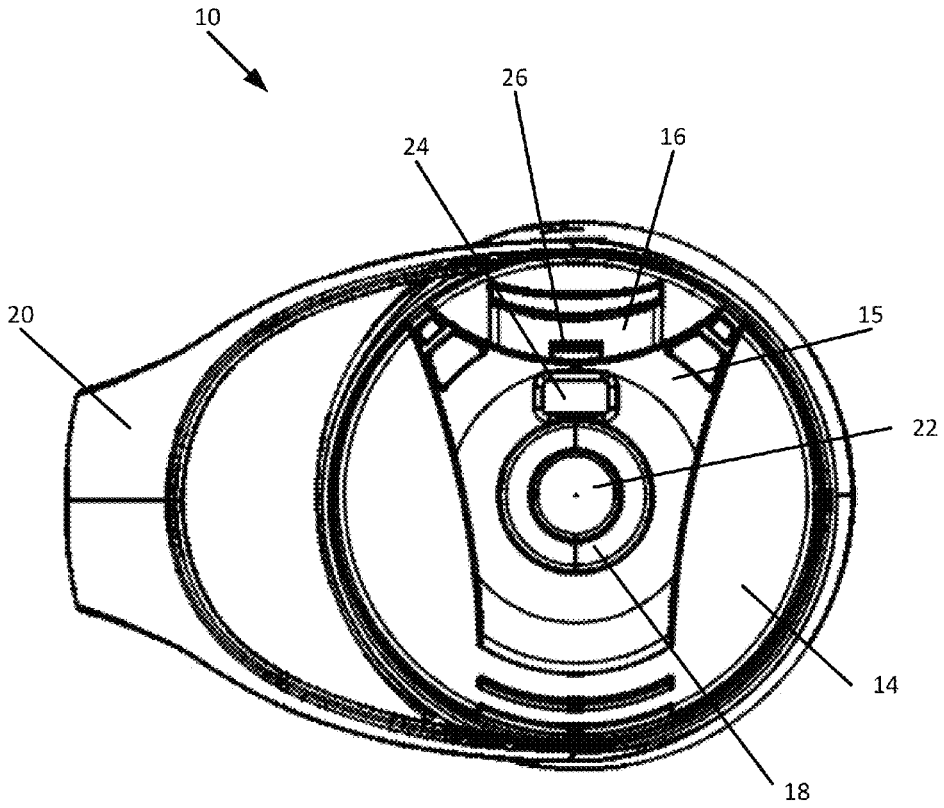
FIG. 4 is a top view of the drink bottle of FIG. 1.
Figure 5:
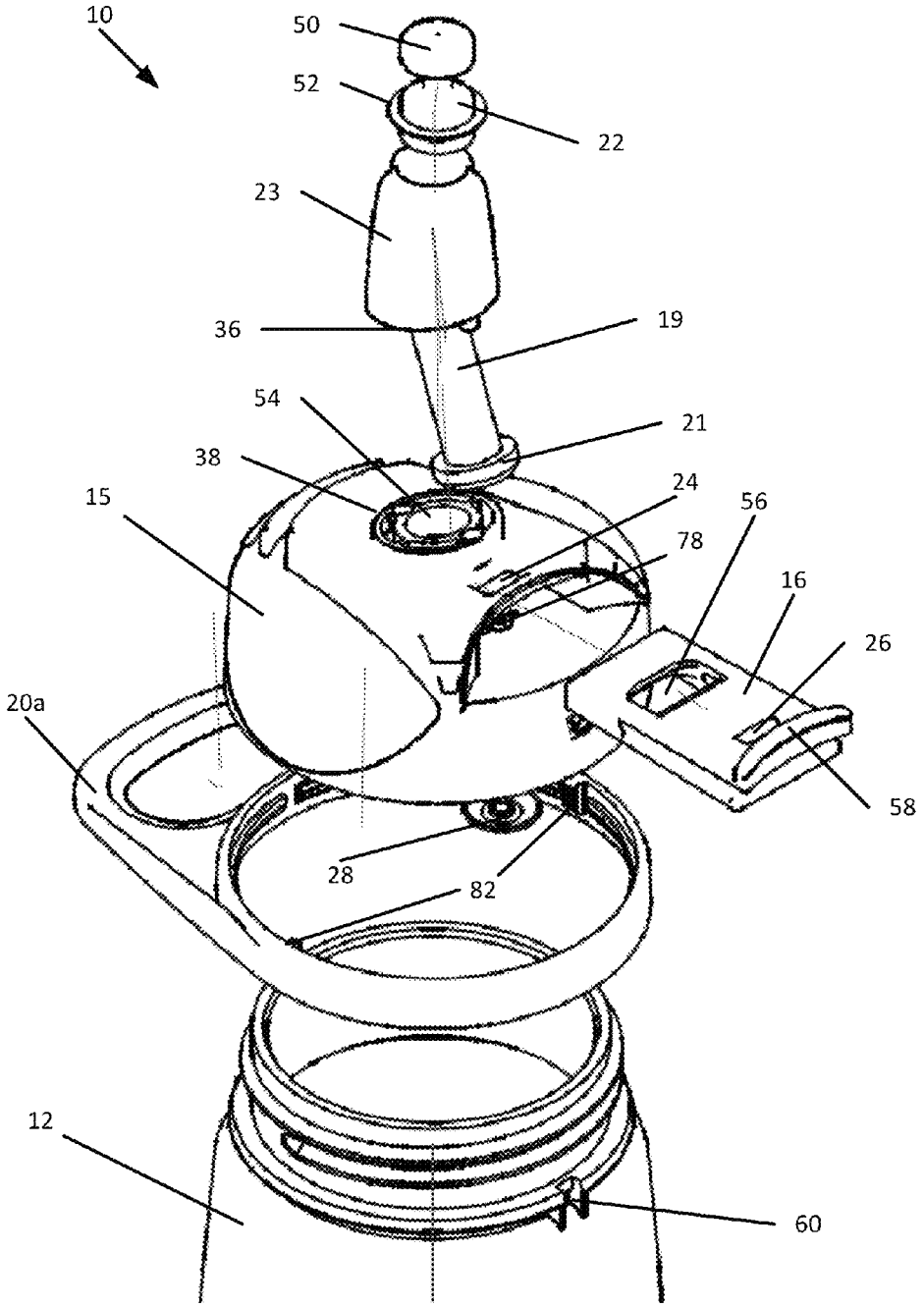
FIGS. 5 and 6 are exploded views of the bottle of FIG. 1.
Figure 6:
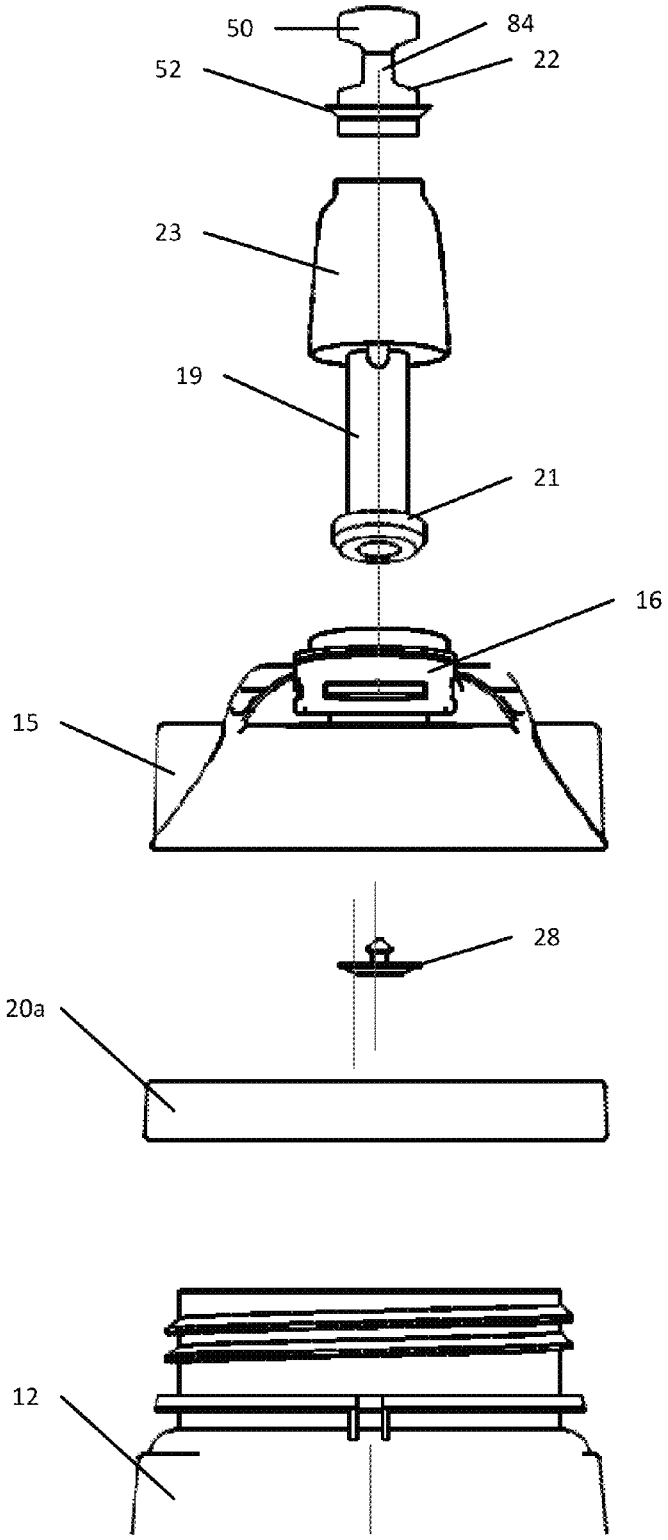

In some embodiments, the disclosed drink bottle 10 includes a contoured, flexible bottle 12 with one or more sealable upper openings, and a cap assembly 14 that covers the bottle opening. The cap assembly 14 can include a rigid cap body 15 that is removably attachable to the bottle, such as via threads, and a spout 18 that can include a mouthpiece valve. As shown in FIGS. 5 and 6, the spout 18 can comprise a flexible outer sheath 23 and a relatively more rigid stem 22 arranged within the sheath to form a mouthpiece valve that allows fluid flow between the stem and sheath when the bottle is squeezed and/or when the sheath is deformed, such as when a user pinches or bites on the sheath.

The spout 18 can also include a tube, or straw, 19 that extends below the mouthpiece valve through the cap body 15, such as an extended portion of the flexible outer sheath 23. Fluid from the bottle 12 flows through the tube 19, around and/or through apertures in the stem 22 within the sheath 23, and out of the upper outlet of the spout. The sheath 23 and tube 19 of the spout 18 can comprise a resiliently flexible material, such as an elastomeric material. The sheath portion 23 of the spout can be positioned on top of the cap body 15, while the tube portion 19 passes through the cap body to the interior of the bottle 12.

Figure 7:
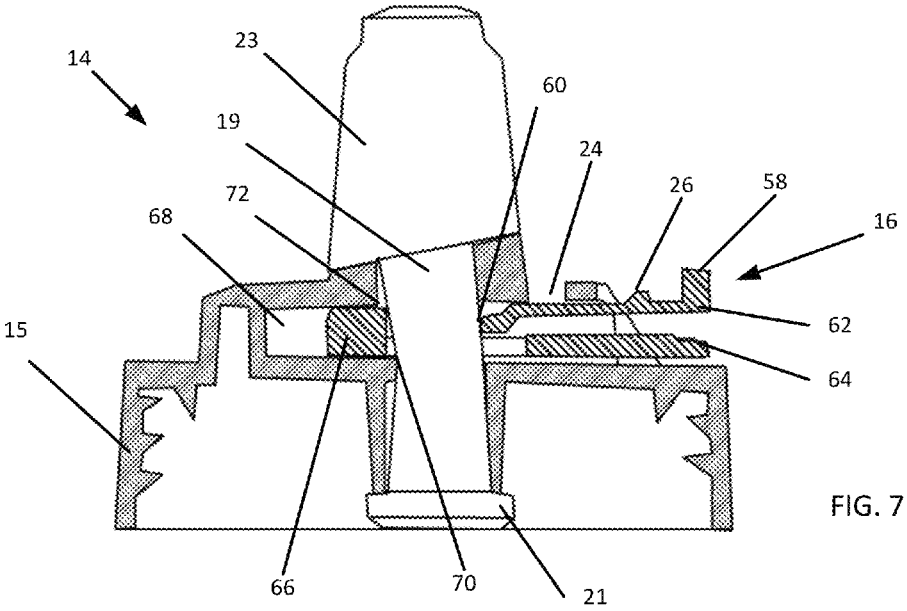
FIGS. 7 and 8 are cross-sectional views of a cap assembly of the drink bottle of FIG. 1, showing a shut-off valve in open and closed positions, respectively.
Figure 8:
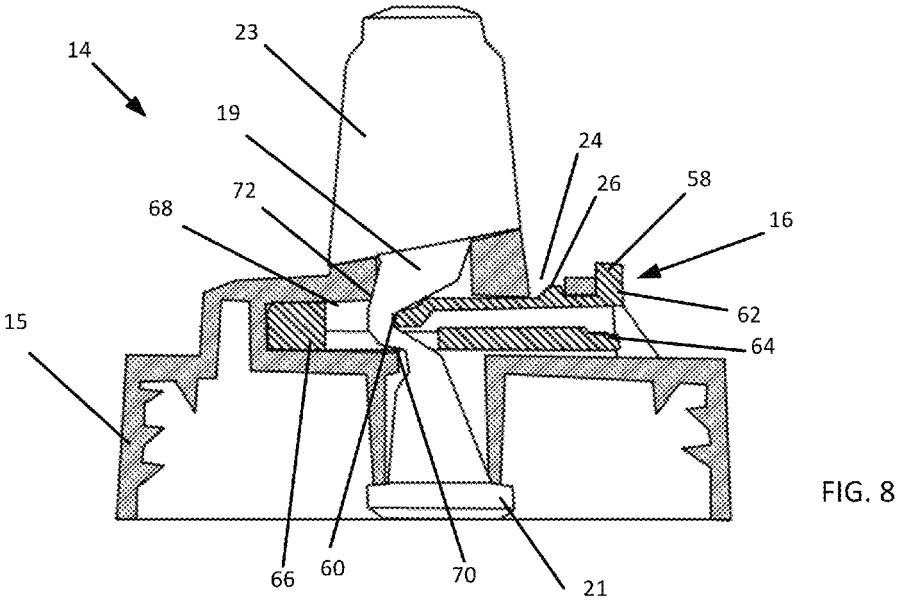

The cap assembly 14 can also include a spout shut-off trigger 16. As shown in FIGS. 7 and 8, the shut-off trigger 16 is mounted in the cap body 15 such that it can be moved between an open position (FIG. 7) and a closed position (FIG. 8). In the closed position, the trigger 16 compresses the spout tube 19, causing the spout tube to seal below the mouthpiece valve, preventing fluid flow into the mouthpiece.

Figure 11:
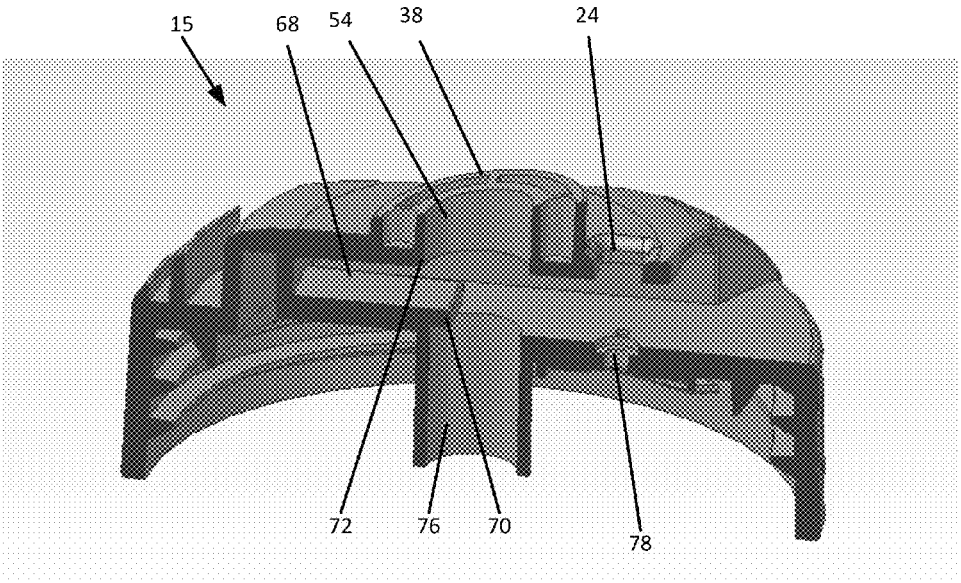
FIG. 11 is a cross-sectional view of a cap body of the drink bottle of FIG. 1.

An air inlet 78 (see FIGS. 5 and 11) can be integrated into the cap body 15, or other component of the cap assembly 14, and can cooperate with a one way valve 28, such as an umbrella valve (see FIG. 5), that allows air flow into the bottle 12 through the inlet 78, but prevents the bottle's contents from escaping. The valve 28 can be mounted over the inlet 78 on the inside surface of the cap body 15.

The bottle 12 can be configured to provide pressure generation via squeezing of the bottle. The bottle can have a contoured shaped for easy loading into a pack holster or the like, and a comfortable fit against the body. The bottle can be constructed from a flexible plastic material, or similar material. The bottle's mid to upper grasping portion can be generally cylindrical in cross-section while the lower portion can be tapered and/or have a contoured cross-section. The cylindrical mid to upper portion can provide an easy-to-grasp, hand-sized, symmetrical form that provides efficient displacement under squeezing force and positive resiliency during bottle re-expansion. As a result, moderate hand pressure on the bottle can push a generous amount of fluid out of the spout and the bottle can readily return to form after each squeeze. The bottle can taper and/or flatten on one side from about midway down. In some embodiments, the lower portion of the bottle can have a generally ovular, D-shaped, or kidney shaped cross-section. Such a contoured lower portion can facilitate bottle holstering or placement against a user's body. The bottle's flattened side 80 can face the user's body when the bottle is carried in pocket or a pack providing a secure, conforming fit.

In some embodiments, the bottle's upper neck around the upper opening can include indexing notches and/or locking features 60 (see FIG. 5) for attaching various handles to the bottle such that the handle is secured and cannot twist relative to the bottle. The handles can have corresponding indexing or locking features 82 that can be received in respective features 60 of the bottle. FIGS. 1-4 show a first exemplary handle 20 and FIGS. 5, 6, 9, and 10 show another exemplary handle **20*a*. Handle 20 is shaped to assist handheld use of the bottle or for hanging the bottle. Handle 20*a*** offers a loop for pulling the bottle from a bottle holster or other holder, or for coupling a cord or clip to the loop.

In some embodiments of the spout 18, the outer sheath 23 and the tube 19 can be a one-piece structure of flexible material, such as elastomeric material. In other embodiments, the outer sheath 23 and the tube 19 can be separate pieces attached together and/or of different materials. The outer sheath 23 includes an upper end with an opening that acts as a fluid outlet, and a lower, base end that connects to the tube 19. The tube 19 has an upper end that connects to the sheath 23 and a lower end that acts as a fluid inlet. The spout 18 can be mounted to the cap body 15 via insertion of the tube portion 19 through a passageway 54 in the cap body 15 (see FIGS. 5 and 11). The tube 19 can include an external flange 21 at its lower end that helps anchor the spout 18 to the underside of the cap body 15.

The inner stem 22 of the mouthpiece valve is positioned within the outer sheath 23 of the spout and can include features, such as annular flange 52 (FIG. 5), that engage with the interior surface of the outer sheath 23 to keep the stem 22 housed securely within the outer sheath. The inner stem 22 can include apertures extending axially through the stem radially inward from the annular flange 52 to provide a flow path through the stem in embodiments where the annular flange 52 forms a permanent seal against the inner surface of the sheath 23 all the way around the stem. The inner stem 22 can also include a disc-shaped sealing member 50 at its upper end that seals against the interior surface of the outer sheath 23 at the sheath's upper outlet end.

Flow can occur through the mouthpiece valve via internal pressurization within the spout 18 or via deformation of the outer sheath 23, such as by biting or pinching the sheath below the stem's disk-shaped sealing member 50 at a necked down portion 84 of the stem 22. Sufficient pressurization of the space within the sheath 23 causes the sheath to expand where it is normally sealed against the valve stem 22 allowing fluid to exit the spout's upper outlet. The mouthpiece valve can also open when the sheath 23 is squeezed or bitten down upon. Bilateral compression of the sheath 23 just below the stem's upper sealing member 50 deforms the sheath and disrupts the seal between the two allowing fluid flow therebetween. For example, the sheath 23 is normally sealed against the flange 52 and the sealing member 50 of the stem, though liquid can bypass the flange 52 via the apertures in the stem in certain embodiments. Compressing the portion of the sheath 23 at the necked down portion 84 disrupts the sealing engagement with member 50 and/or with flange 52 enough to allow liquid to flow through the mouthpiece.

Figure 9:
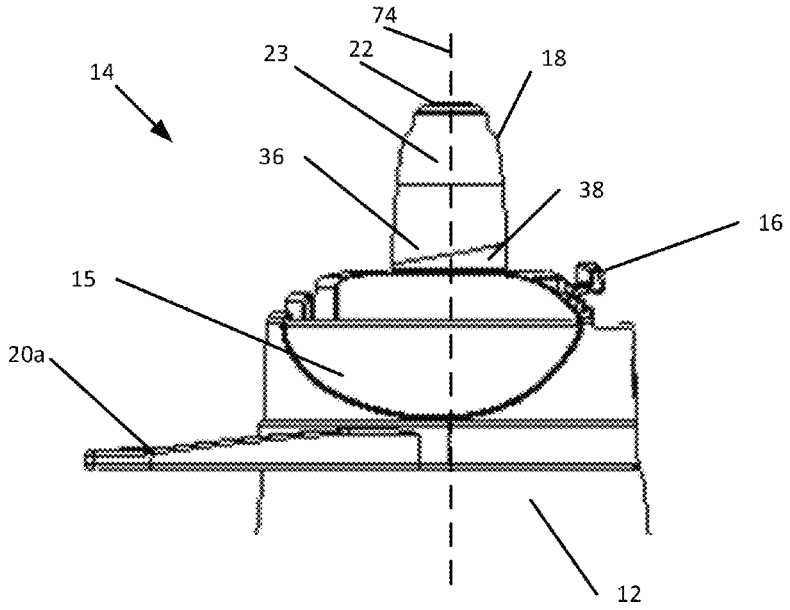
FIGS. 9 and 10 show a mouthpiece of the drink bottle of FIG. 1 in a vertically aligned position and an angled position, respectively.
Figure 10:
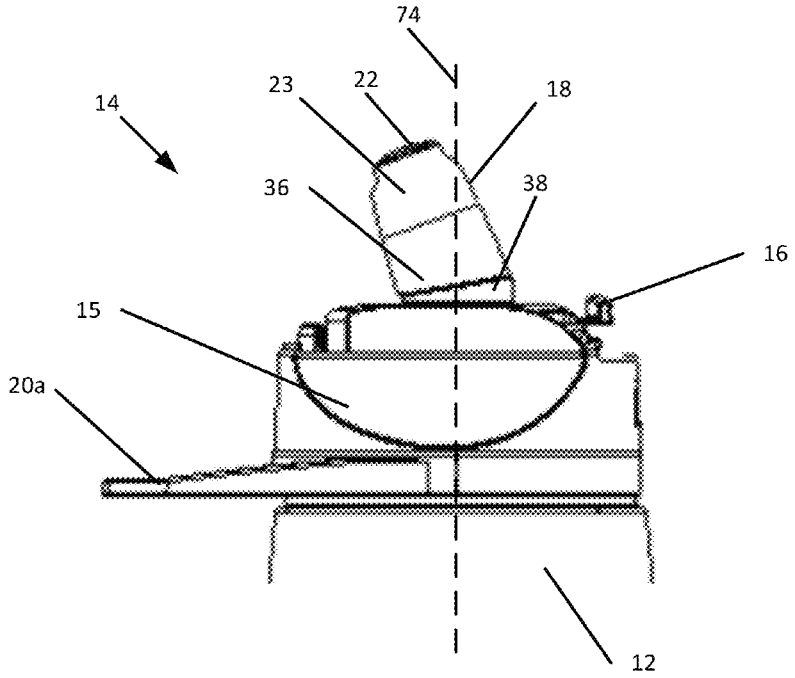

In some embodiments, the spout 18 can be mounted to the cap body 15 such that rotation of the spout mouthpiece provides variable mouthpiece positions relative to the cap body. As shown in FIGS. 9 and 10, the cap body 15 can include an upper mouthpiece seat 38 that is angled relative to the longitudinal axis 74 of the bottle 12 and the passageway through the cap body 15. The lower base end 36 of the outer sheath 23 can be correspondingly angled such that at one rotational orientation of the mouthpiece relative to the cap body, as shown in FIG. 9, the mouthpiece is directed in axial alignment with the longitudinal axis 74 (i.e., the mouthpiece is parallel to the axis 74). Rotation of the mouthpiece relative to the cap body can bring the mouthpiece out of alignment with the longitudinal axis 74 (i.e., the mouthpiece is at an acute, non-zero angle relative to axis 74), providing for different drinking angles. In FIG. 10, the mouthpiece has been rotated 180 degrees from the position of FIG. 9.

In some embodiments, the cap assembly 14 includes a shut-off mechanism for blocking flow through the tube portion 19 of the spout. As shown in FIGS. 7 and 8, a shut-off trigger 16 can be mounted in a laterally slidable fashion within a housing of cap body 15. The shut-off trigger 16 can include an actuation portion 58 which protrudes from the housing at a convenient location for actuation by the user. The shut-off trigger 16 can also include a catch 26 adjacent to the actuation portion 58 that can be releasably locked to the cap body 15 in the closed position, as shown in FIG. 8. The shut-off trigger 16 can have a spring-like configuration or other biasing feature that biases the catch 26 towards its locked position. The shut-off trigger 16 also includes a first sealing edge 60 adjacent the tube 19 that can act against the tube to close off the tube. The cap body 15 includes one or more sealing surfaces, such as 70 and 72, situated on an opposite side of the tube 19 from the trigger's sealing edge 60. The spout tube 19 passes between the trigger's sealing edge 60 and the cap body's sealing surfaces 70, 72. The sealing surfaces of the cap body can be offset from the sealing edge of the trigger to cause the tube to kink in the closed position (FIG. 8) for better sealing. Movement of the trigger 16 in radially inward relative to the cap body 15 causes the tube 19 to be compressed between the sealing edge 60 of the trigger and the sealing surfaces 70, 72 of the cap body, such that the tube buckles and collapses to block off flow through the tube.

The trigger's catch 26 can operate such that it engages an opening or recess 24 in the cap body 15 and locks to the cap body when the tube is collapsed and sealed. Releasing of the trigger's catch 26 allows the tube to resiliently rebound to its open position, pushing the trigger's sealing edge 60 back away from the cap body's sealing surfaces 70, 72. In some embodiments, a spring-like construction of the trigger 16 and/or an additional biasing mechanism can also help cause the trigger to move outwardly to the open position. The shut-off trigger 16 and catch mechanism 26, 24 can be designed such that pushing the trigger inward toward the tube 19 shuts off flow and engages the trigger lock, while downward force on the trigger actuation portion 58 or catch 26 releases the trigger lock and unseals the spout tube.

Figure 12:
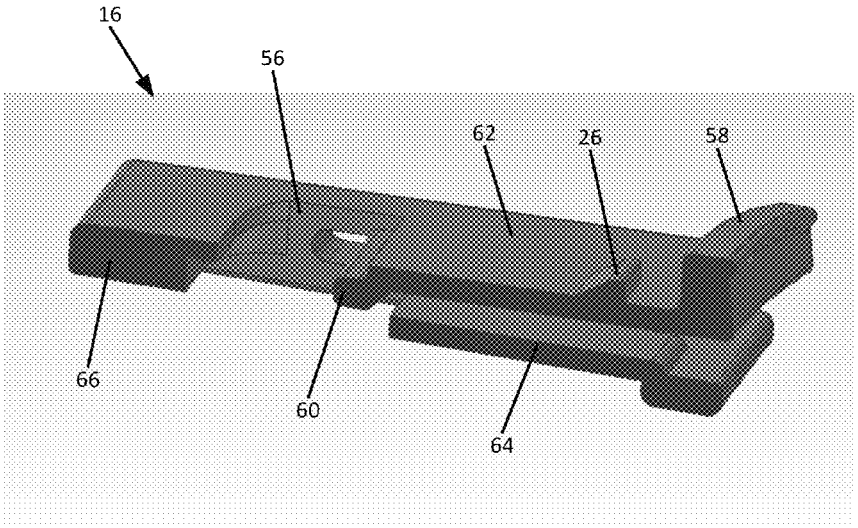
FIG. 12 is a cross-sectional view of a shut-off trigger of the drink bottle of FIG. 1.

The trigger 16 can include a passageway 56 through which the spout tube passes, wherein a portion of the passageway 56 forms the sealing edge 60 of the trigger, as shown in FIG. 12. As shown in FIGS. 7 and 8, an inner end portion 66 of the trigger 16 on the opposite side of the passageway 56 from the sealing edge 60 can slide in a guide slot 68 of the cap body to assist the sliding motion of the trigger relative to the cap body between the open and closed positions. The passageway 56 in the trigger can fully or partially surround the tube 19 such that the trigger is retained in the cap body and prevented from sliding all the way out of the cap body beyond the open position.

In some embodiments, the trigger can comprise a spring-like, V-shaped or U-shaped configuration, such as shown in FIG. 12, having an upper arm 62 and a lower arm 64 each having a passageway 56 for the tube 19 to pass through. The upper and lower arms 62, 64 can be coupled together by the inward end portion 66 that biases the arms apart from each other. The upper arm 62 can include the trigger catch 26 such that the upper arm is pressed down by the user to release the catch from the recess or opening 24 in the cap body. When the trigger 16 is pressed inward toward the locked position, the two arms 62, 64 are elastically deformed together by contact with the cap body 15, storing resilient energy that assists in causing the trigger 16 to slide back outward to the open position when the user releases the trigger lock. Expansion of the collapsed tube 19 also helps push the trigger 16 back outward to the open position. One or both of the upper and lower arms 62, 64 can comprise a sealing edge 60 that collapses the tube 19 in the closed position.

In various embodiments of the drink bottle described herein, variations to the features of the bottle and cap assembly can be employed to achieve the same objectives in different manners. Thus, the particular embodiments illustrated and described herein are not limiting in their exact construction, but instead provide examples of the novel concepts disclosed herein. In some alternative embodiments, the bottle and spout may be integrated as one assembly while the cap body and shut-off trigger form a separate assembly. In some embodiments, the bottle can be constructed of materials other than elastomeric material that still achieve the goal of efficient squeezability and resilience. In some embodiments, the bottle may be integrated with a squeeze pump that draws fluid from a reservoir within the bottle and pushes it out of the mouthpiece valve. Alternative check valve and bite valve design combinations can also be utilized. The bottle's air inlet can be combined with the mouthpiece valve in various fashions. Other spout shut-off mechanisms may be employed, such as stopcock-type valves, push/pull poppet-type valves, twistable, threaded poppet-type valves, and other pinched/kinked straw arrangements including magnetic powered kinking mechanisms.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the term "and/or" used between the last two of a list of elements means any one or more of the listed elements. For example, the phrase "A, B, and/or C" means "A," "B," "C," "A and B," "A and C," "B and C" or "A, B and C." As used herein, the term "coupled" generally means physically linked and does not exclude the presence of intermediate elements between the coupled items absent specific contrary language.

In view of the many possible embodiments to which the principles disclosed herein may be applied, it should be recognized that the illustrated embodiments are only preferred examples and should not be taken as limiting the scope of the disclosure. Rather, the scope of the disclosure is defined by the following claims. I therefore claim as my invention(s) all that comes within the scope and spirit of these claims.

I claim:

1. A cap assembly for a liquid container, comprising:

a rigid cap body configured to be secured to a liquid container;

a spout comprising a resiliently flexible tube extending through a passageway in the cap body, the tube comprising an inner lumen for conducting liquid; and a shut-off trigger slidably mounted in the cap body and adjustable between an open position and a closed position relative to the cap body, wherein when the trigger is in the open position, the lumen within the tube is open to allow liquid to flow through the spout, and when the trigger is in the closed position, the lumen within the tube is closed to block liquid flow through the spout;

wherein the trigger comprises a sealing edge that presses against a side of the tube and collapses the tube against a sealing surface of the cap body when the trigger is in the closed position, and the sealing edge moves away from the sealing surface of the cap body when the trigger moves toward the open position to allow the lumen with the tube to open;

wherein the trigger further comprises a catch that engages with the cap body when the trigger is in the closed position to lock the trigger in the closed position, and the catch can be released from the cap body by a user to allow the trigger to move to the open position;

wherein the trigger has a spring-like configuration; and wherein the trigger comprises a first arm and a second arm that are coupled at an inner end portion of the trigger, such that the first and second arms are biased apart from each other by the inner end portion.

2. The cap assembly of claim 1, wherein the tube extends in a generally axial direction through the passageway in the cap body and the trigger is slidable in directions generally perpendicular to the axial direction.

3. The cap assembly of claim 1, wherein the trigger comprises a passageway through which the tube extends, and the sealing edge is at one side of the passageway of the trigger.

4. The cap assembly of claim 1, wherein the cap body comprises a slot that receives the trigger, the slot intersecting the passageway through the cap through which the tube extends, such that the slot and the passageway in the cap body are generally transverse to each other.

5. The cap assembly of claim 1, wherein the first and second arms are elastically bent toward each other when the trigger moves toward the closed position, and the first and second arms resiliently separate apart from each other when the trigger moves toward the open position.

6. The cap assembly of claim 5, wherein the first arm includes the catch facing away from the second arm such that the catch is biased against the cap body.

7. The cap assembly of claim 6, wherein when the trigger is in the closed position, the first arm must be bent toward the second arm to release the catch from the cap body and allow the trigger to move toward the open position.

8. The cap assembly of claim 1, wherein the inner end portion of the trigger and the sealing edge of the trigger are positioned on opposite sides of the tube.

9. The cap assembly of claim 1, wherein the sealing surface of the cap body is offset axially from the sealing edge of the trigger, such that when the trigger is in the closed position, the tube is kinked out of axial alignment.

10. The cap assembly of claim 1, wherein the spout further comprises a flexible outer sheath coupled to an upper end of the tube such that the inner lumen extends through the tube and the outer sheath, the outer sheath being positioned on an upper side of the cap body, and the spout further comprises a rigid stem positioned within the outer sheath, such that the outer sheath and the stem form a valve that allows liquid flow from the tube, between the outer sheath and the stem, and out of the spout.

11. The cap assembly of claim 10, wherein the outer sheath comprises an inner annular surface that seals around an outer annular surface of the stem to prevent fluid flow through the spout, and wherein the inner annular surface of the outer sheath can be elastically deformed away from the outer annular surface of the stem to allow fluid flow out of the spout by increasing fluid pressure within the lumen or by pinching the outer sheath.

12. The cap assembly of claim 1, wherein the spout further comprises a mouthpiece coupled to the tube and positioned outside of the cap body, wherein the mouthpiece is rotatable relative to the cap body, and wherein rotating the mouthpiece relative to the cap body changes an angle at which the mouthpiece extends from the cap body.

13. The cap assembly of claim 12, wherein at one rotational position, the mouthpiece extends upwardly from the cap body in a direction generally aligned with a longitudinal axis of the tube, and at another rotational position, the mouthpiece extends from the cap body at an angle from the longitudinal axis of the tube.

14. A drink bottle comprising:

an elastically squeezable fluid container having an upper opening; and a cap assembly removably coupled to the upper opening of the fluid container;

wherein the cap assembly comprises a cap body, a spout having a flexible tube passing through the cap body for conducting fluid out of the fluid container, and a trigger configured to releasably close the tube to prevent fluid flow through the spout;

wherein the trigger is configured to be pushed inwardly relative to the cap body from an open position to cause a sealing edge of the trigger to collapse the tube in a closed position, and such that a catch on the trigger engages with the cap body in the closed position to lock the trigger in the closed position until the catch is manually released;

wherein the spout further comprises a mouthpiece valve positioned above the cap body and coupled to the tube, the mouthpiece valve comprising a flexible outer sheath and a rigid stem positioned within the outer sheath, such that the mouthpiece valve forms a seal between the outer sheath and the stem to prevent fluid flow through the spout, and such that the seal is openable to allow fluid to flow through the tube, between the outer sheath and the stem, and out of the spout when trigger is in the open position and the fluid container is squeezed; and wherein the trigger comprises a first arm and a second arm that are coupled at an inner end portion of the trigger, such that the first and second arms are biased apart from each other by the inner end portion and elastically bent toward each other by contact with the cap body, such that when the trigger is pushed toward the closed position the cap body causes the two arms to deflect toward each other, and the first and second arms resiliently separate apart from each other when the trigger moves toward the open position.

15. The drink bottle of claim 14, wherein the seal can also be opened by pinching the outer sheath below the seal.

16. The drink bottle of claim 14, further comprising a modular handle, wherein the fluid container and the modular handle comprise corresponding indexing features of locking features that prevent the handle from rotating relative to the fluid container.

17. The drink bottle of claim 14, wherein the fluid container has an upper portion having a generally circular cross-sectional shape and a lower portion having a generally D-shaped or kidney-shaped cross-sectional shape.

18. The drink bottle of claim 14, wherein the mouthpiece valve is rotatable relative to the cap body, and wherein rotating the mouthpiece valve relative to the cap body changes an angle at which the mouthpiece valve extends from the cap body, such that at one rotational position the mouthpiece valve extends upwardly from the cap body in a direction generally aligned with a longitudinal axis of the bottle, and at another rotational position the mouthpiece valve extends from the cap body at an angle from the longitudinal axis of the bottle.

* * * * *